US005581897A

United States Patent [19]

Liebscher

[11] Patent Number: 5,581,897

[45] Date of Patent: Dec. 10, 1996

[54] PLIER-TYPE CAN OPENER

[75] Inventor: Johannes Liebscher, Nassau/Lahn, Germany

[73] Assignee: Leifheit AG, Nassau/Lahn, Germany

[21] Appl. No.: 164,903

[22] Filed: Dec. 10, 1993

[30] Foreign Application Priority Data

Dec. 10, 1992 [DE] Germany ..... 42 41 535.7

[51] Int. Cl.[6] ..... B67B 7/72

[52] U.S. Cl. ..... 30/416; 30/427; 30/434

[58] Field of Search ..... 30/400, 409, 416, 30/426, 427, 433, 434

[56] References Cited

U.S. PATENT DOCUMENTS

| | | | |
|---|---|---|---|
| 2,486,314 | 10/1949 | Montgomery | 30/417 |
| 2,644,228 | 7/1953 | McLean | 30/427 |
| 2,866,263 | 12/1958 | McLean | 30/427 X |
| 2,984,904 | 5/1961 | McLean | 30/426 |
| 3,129,509 | 4/1964 | McLean | 30/426 |
| 5,197,197 | 3/1993 | Himmighofen et al. | 30/426 X |

FOREIGN PATENT DOCUMENTS

| | | | |
|---|---|---|---|
| 1352628 | 1/1964 | France . | |
| 4210549 | 11/1992 | Germany . | |
| 608226 | 12/1978 | Switzerland . | |
| 603943 | 6/1948 | United Kingdom | 30/427 |

*Primary Examiner*—Rinaldi I. Rada
*Assistant Examiner*—Raymond D. Woods
*Attorney, Agent, or Firm*—Frishauf, Holtz, Goodman, Langer & Chick

[57] ABSTRACT

A plier-type can opener has two arms 1, 2 that are pivotally connected to one another. The rotatable parts required for the can opener to cut open a lid of a can and to advance the can are combined into preassembled units that are mountable to the arms. The rotatable parts include a cutting wheel 5, a feed wheel 7, a turning handle 4 and toothed wheels 6, 8. The rotatable parts included in the units are respectively mounted in respective cutouts on the arms 1, 2. The cutouts open toward each other and are provided on an inside edge portion of each arm so that after the units are pressed into respective cutouts, then during use of the can opener when the arms are closed to open a can, the closing of the arms enhances retention of the units in their respective cutouts.

3 Claims, 5 Drawing Sheets

PLIER-TYPE CAN OPENER

BACKGROUND OF THE INVENTION

1. Field of the Invention

The invention relates to a plier-type can opener.

2. Description of the Prior Art

In known plier-type can openers, the turning handle is mounted in one arm of the can opener. The one arm supports either the feed wheel or a toothed wheel so that, when the pliers are closed, the feed wheel engages another toothed wheel mounted in the other arm of the can opener and the feed wheel is connected to the cutter which is embodied as a cutting wheel. Alternatively, the feed wheel can support the cutting wheel and a toothed wheel such that, when the pliers are closed, the feed wheel engages one of the toothed wheels that is mounted in the other arm and the feed wheel is connected to the cutting wheel. Plier-type can openers of this kind are relatively expensive to manufacture, because attaching the individual parts to and mounting them on or in the arms requires a relatively great amount of labor. Moreover, during assembly, damage to the arms, which are usually comprised of sheet metal and/or chrome-plated parts, can frequently occur.

SUMMARY OF THE INVENTION

The object of the invention is to provide a plier-type can opener of the above-described generic type which is distinguished by a simple design and in particular by a significantly simplified combination of components therein.

The plier-type can opener of the invention comprises: first and second arms 1, 2 pivotally connected to each other; a turning handle 4 for manually operating the can opener; a plurality of rotatable components including a feed wheel 7, a cutter means 5 and first and second toothed wheels 6 and 8; a first unit mounted on one of said first and second arms, said first unit comprising said turning handle 4 and at least one of said rotatable components; a second unit mounted on the other of said first and second arms, said second unit comprising at least one of said rotatable components other than the at least one rotatable component that is part of said first unit; and said feed wheel 7 being mounted to one of said units so as to rotate as said turning handle 4 is manually turned in order to advance a can being opened.

BRIEF DESCRIPTION OF THE DRAWINGS

Several embodiments of the invention are described below with reference to the drawings wherein.

DETAILED DESCRIPTION

Figure 1:
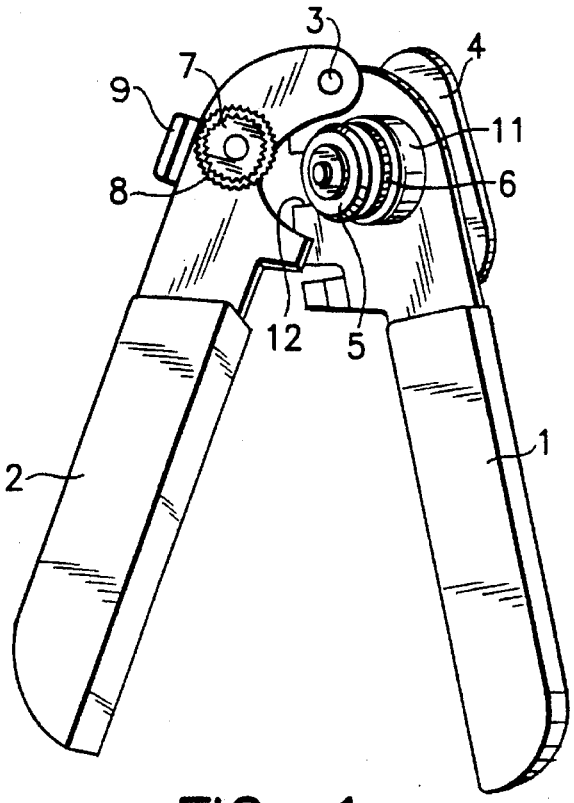
FIG. 1 is a side view of a plier-type can opener of the present invention that is in an open state.

FIG. 1 shows a plier-type can opener of the present invention having two arms 1 and 2, which are provided with handles and which are pivotally connected to one another via a pivot pin 3. The first arm 1 supports a preassembled unit which includes turning handle 4 which is coupled to a cutting wheel 5 and a toothed wheel 6. The second arm 2 supports another preassembled unit including a feed wheel 7 and another toothed wheel 8 connected to feed wheel 7, as well as a spacer 9.

The can opener operates in a conventional manner as follows:

When the arms 1, 2 are pressed or squeezed together, the cutting wheel 5 moves behind a circumferential rim on the lid of a can to be opened and penetrates into the lid, while the feed wheel 7 is pressed from below against the circumferential rim, and the toothed wheels 6 and 8 engage each other. By turning the turning handle 4, the feed wheel 7 is driven via the toothed wheels 6, 8 and in turn rotates the can to cut off the lid of the can. The spacer 9 serves to prevent the feed wheel 7 from dragging at the outer circumference of the can and to assure the correct position of the cutting wheel 5 with respect to the circumferential rim of the can.

Figure 2:
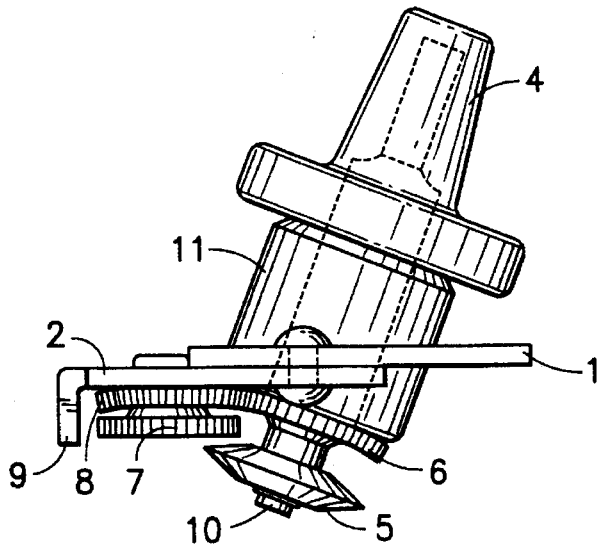
FIG. 2 is a top view of the can opener in FIG. 1 that is in a closed state.
Figure 3:
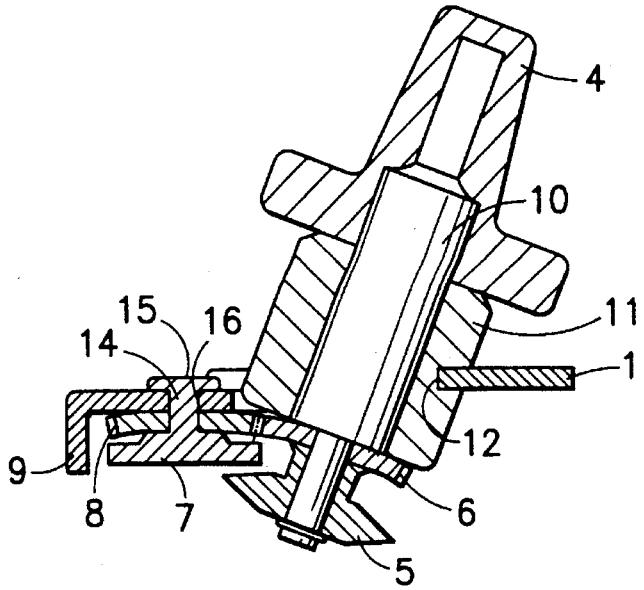
FIG. 3 is a sectional view of the can opener taken through the axis of rotation of the turning handle.
Figure 4:
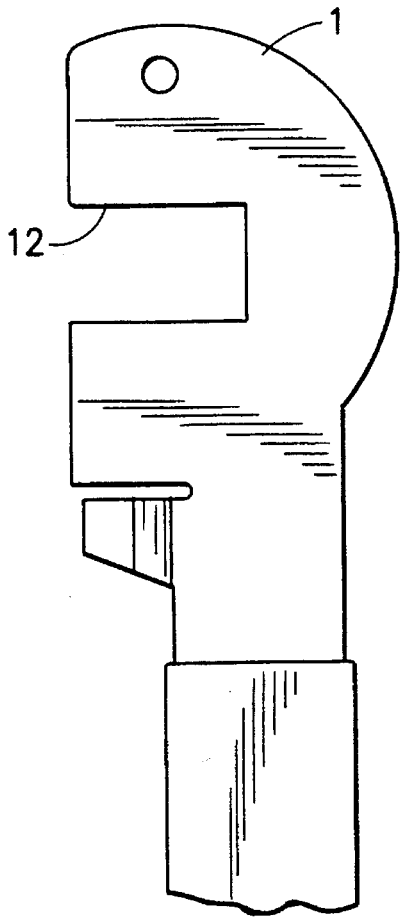
FIG. 4 is a partial view of the first arm of the can opener.
Figure 5:
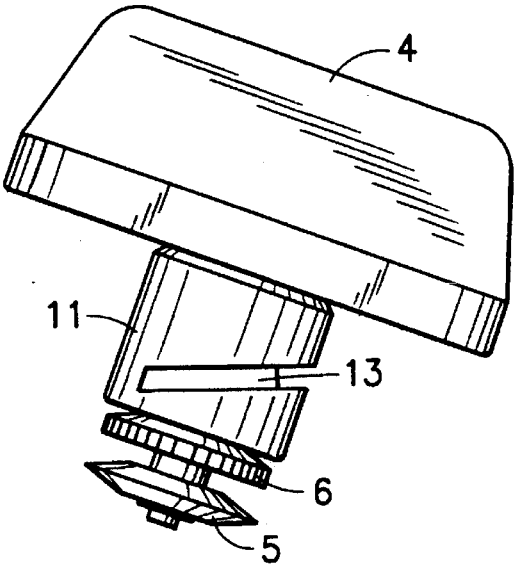
FIG. 5 is a view of one preassembled unit designated for placement on the arm in FIG. 4.

The turning handle 4 has a shaft 10 that extends through a support element 11 and which supports the cutting wheel 5 and the toothed wheel 6 at its free end. The support element 11, turning handle 4, toothed wheel 6, cutting wheel 5 and shaft 10 together comprise a preassembled unit, as shown in FIGS. 2, 3 and 5. A cutout 12 (see FIGS. 1 and 4) is provided in arm 1 to attach the support element 11 of the preassembled unit to the arm 1. The support element 11 has a notch 13 formed in a circumferential surface thereof, as shown in FIG. 5. The width of the notch 13 corresponds to a thickness of the arm 1 formed by a sheet metal part, and the core of the notch 13 corresponds in width to the width of the cutout 12. The support element 11 is inserted by means of its notch 13 into the cutout 12 and is held there by means of a friction fit. As can be seen from FIG. 5, the notch 13 extends in a direction that is inclined with respect to the axis of rotation of the shaft 10, so that the cutting wheel 5 can have a desired inclined position after the insertion of the support element 11 into the cutout 12 of the arm 1.

As shown in FIG. 1, the feed wheel 7 and toothed wheel 8 are mounted on the second arm 2. As best seen in FIG. 3, the toothed wheel 8 is fixedly mounted on the support shaft 14 of the feed wheel 7. At its end facing away from the feed wheel 7, the support shaft 14 has an enlarged head portion 15 of a larger diameter than the support shaft 14. The support shaft 14, feed wheel 7 and toothed wheel 8 together comprise a preassembled unit. To receive this preassembled unit, the second arm 2 is provided with a slit 16 shown in FIG. 3, into which the support shaft 14 is pushed so that there is a frictional fit between the shaft 14 and slit 16. A frictional fix also exists between the arm 2 and the inner surface of head portion 15 and the surface of toothed wheel 8 facing the arm 2.

Because the cutout 12 and the slit 16 are respectively provided at the inside edges of the arms 1, 2 that face each other, the unit including support element 11 and the unit including wheels 7, 8 and support shaft 14 are prevented from being pressed out of the cutout 12 or the slit 16, respectively, when the arms 1, 2 are pressed or squeezed together during opening of a can.

Figure 6:
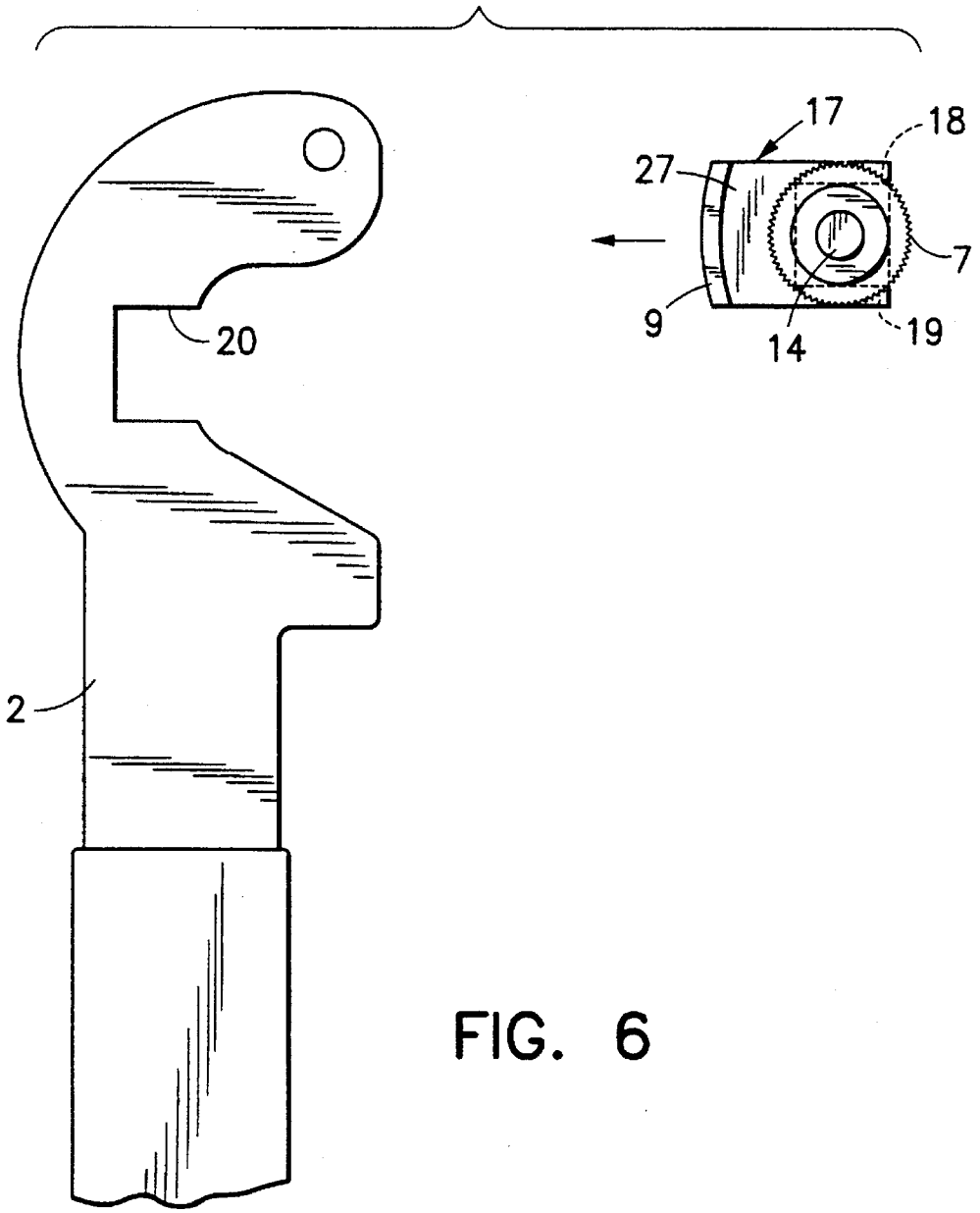
FIG. 6 is a separated representation of a modified embodiment of the second arm with a preassembled unit designated for placement on the second arm.
Figure 7:
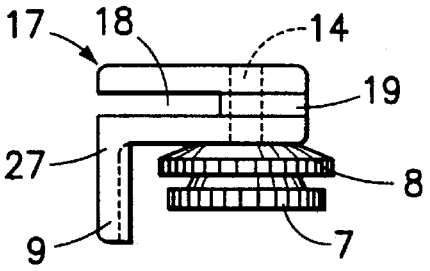
FIG. 7 is a top view of the preassembled unit shown in FIG. 6.

FIGS. 6 and 7 show a second embodiment of the second arm 2 and the unit 17 mounted on it. The unit 17, as seen best in FIG. 7, comprises the feed wheel 7 and toothed wheel 8 mounted on the shaft 14. In this instance, the shaft 14 is mounted in a plastic part 17 having a slit 18 that continues in a groove 19 at both sides of the plastic part 27. The solid portion of plastic part 27 between the grooves 19 and slit 18 serves as a bearing for the shaft 14. The arm 2 has a cutout 20 shown in FIG. 6, into which the plastic part 27 is pushed and held in frictional engagement. The spacer 9 of FIG. 7, which in the preceding example is formed by a tab bent out of the plane of the arm 2, is formed by the plastic part 27, which is preferably a molded part.

Figure 7A:
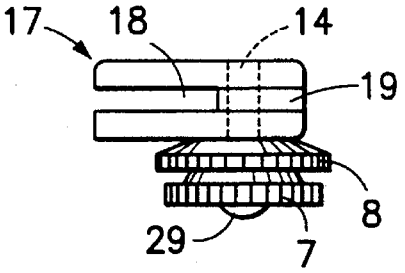
FIG. 7A is a top view of a modified embodiment of the preassembled unit of FIG. 7 in which a spacer element is provided at a center position thereof.

In FIG. 7A, the shaft 14 is shown to be in the form of a pin having a rounded head 29 which functions as a spacer.

Figure 11:
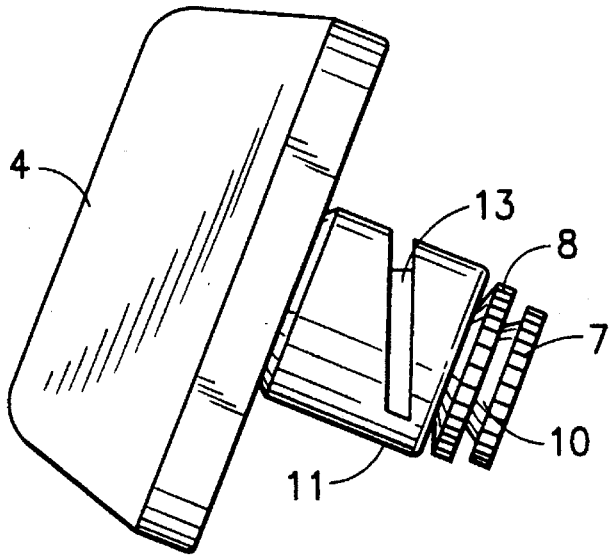
FIG. 11 is identical to FIG. 8 except that the feed wheel 7' and the cutter means 5 of FIG. 8 have been respectively replaced by toothed wheel 8 and feed wheel 7.
Figure 12:
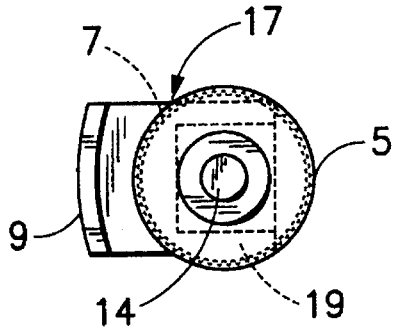
FIG. 12 shows a preassembled unit similar to that of FIG. 6 but wherein the feed wheel 7 is replaced with cutter means 5.
Figure 14:
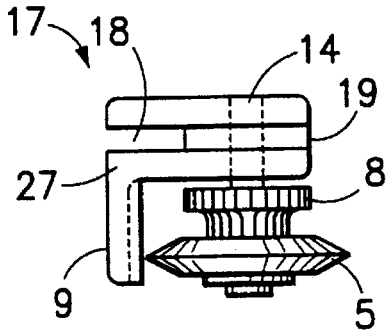
FIG. 14 is similar to FIG. 7, but wherein the cutter wheel 5 replaces the feed wheel 7 on shaft 14.

Unlike in the above-described embodiments, the cutting wheel 5 can instead be mounted on the shaft 14 (see FIGS. 12 and 14), and the feed wheel 7 can be disposed on the turning handle shaft 10 (see FIG. 11).

Figure 8:
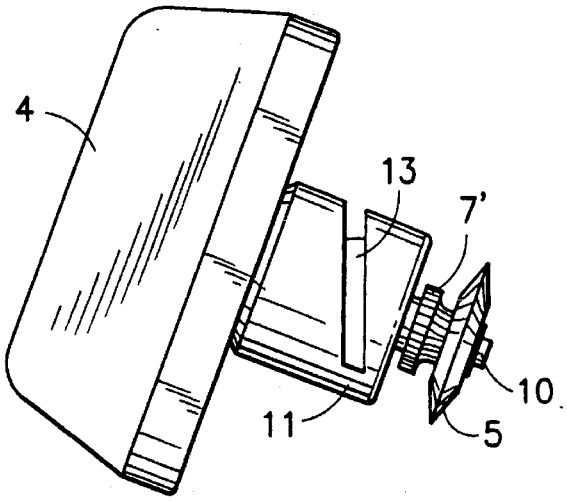
FIG. 8 is a view of a unit similar to that shown in FIG. 5, but with a turning handle on whose shaft the cutting wheel and the feed wheel are disposed.
Figure 9:
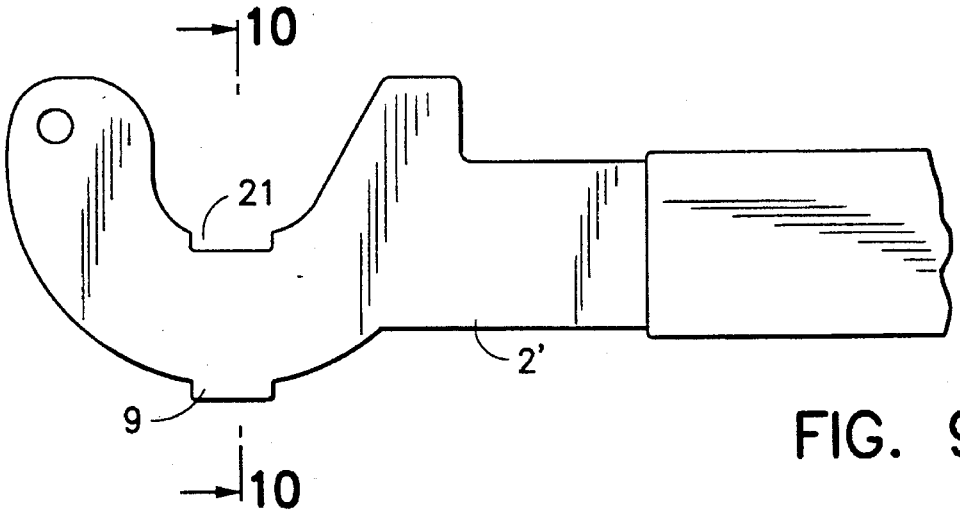
FIG. 9 is a side view of the second arm of the can opener in a further embodiment.
Figure 10:
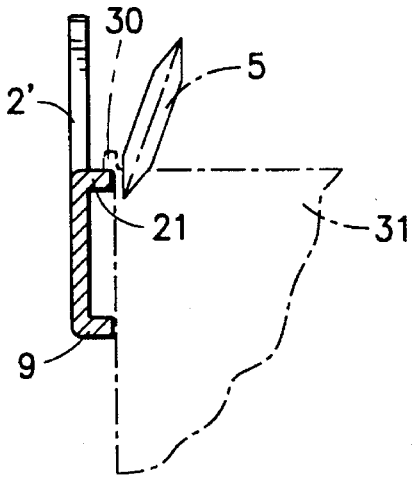
FIG. 10 is a sectional view along line 10—10 in FIG. 9, rotated by 90°, wherein a part of the can to be opened and the cutting wheel are shown in dash-dot lines.
Figure 13:
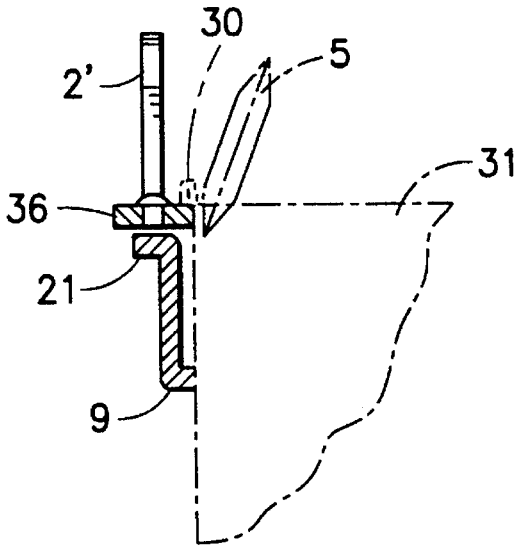
FIG. 13 is similar to FIG. 10, but wherein the support element 21 is bent away from the can 31 and the roller means 36 has been added.

The individual parts of a further embodiment are shown in FIGS. 8–10. As in FIG. 5, in FIG. 8, the shaft 10 of the turning handle 4 is mounted in the support element 11. The difference between the embodiments shown in FIGS. 5 and 8 is that, in the embodiment of FIG. 8, along with the cutting wheel 5, the feed wheel 7' is also disposed on the shaft 10. The embodiment of FIG. 11 is identical to FIG. 8 except that the cutting wheel 5 of FIG. 8 is replaced with the feed wheel 7 and the feed wheel 7' of FIG. 8 is replaced with a toothed wheel 8. The support element 11 is inserted into the cutout 12 of the first arm 1, via inclined notch 13, as described in connection with FIGS. 3–5. The second arm 2' shown in FIG. 9 is provided at its edge facing the first arm with a support device 21 that, as shown schematically in FIG. 10, engages the underside edge of the rim 30 of a can 31 to be opened and supports the can 31 with respect to the cutting wheel 5. To reduce friction, the support device 21 can be replaced with a roller 36 shown in FIG. 13. The arm 2' as shown in FIG. 10 is provided with a spacer 9, which operates in a manner similar to the spacer 9 formed on arm 2 in FIG. 1. The support device 21 and the spacer 9, in the embodiment of FIGS. 9, 10 and 13, are formed by tabs bent out of the plane of the arm 2' which is formed of a sheet metal part. As shown in FIG. 13 the support device 21 can be bent in a direction away from the can 31.

As is known, a stationary cutter can be provided in place of the cutting wheel 5. This can be accomplished by making the cutting wheel 5 non-rotatable or by replacing the cutting wheel with a pointed, sharp-edged piercing element (not shown). Such a piercing element has a pointed end and a sharp edge portion for cutting open a lid of a can as the can is moved past the sharp edge portion.

As is evident, in all of the above-described embodiments of the invention, the elements required for opening the can, particularly the cutting wheel 5 or stationary cutter 33 and the feed wheel 7, 7' and, optionally, the toothed wheels 6 and 8 provided for transmitting the rotational movement of the turning handle 4, are combined into two respective units that are preassembled and are simply placed onto the pivotally connected arms of the can opener via respective cutouts in the first and second arms. By means of this, manufacture and assembly of the can opener are greatly simplified, and the resulting can opener has a high degree of structural integrity since the applied forces during use, are in such a direction as to enhance engagement of the parts rather than to cause disengagement of the parts.

As a rule, the spacer that rests against a circumferential wall of a can (see FIGS. 10 and 13) when the can opener is in use, and which assures a correct inclination of the can with respect to the cutting wheel, is disposed on the arm that supports the feed wheel. This spacer as indicated hereinabove can then be mounted on the respective support element that supports the feed wheel.

It is also possible (see FIG. 8) to position the turning handle, together with the feed wheel 7' and the cutter preferably embodied as a cutting wheel 5, on a support element 11 placed on one of the arms. In this case the other arm only has a support device 21 for supporting the edge of the can located opposite the feed wheel. If this other arm is formed of a sheet metal part, as is typical, the support device 21 and the spacer 9 can be formed by tabs provided on the sheet metal part that curves upwardly from a plane in which the sheet metal part is located.

Each arm receiving a support element 11, 14, 17 of a preassembled unit is preferably formed of a sheet metal part that has a cutout 12, 20. The support element 11, 14, 17 is provided with a portion 13, 18, 19 whose width corresponds to the width of the sheet metal part, and whose core corresponds to the width of the respective cutout 12, 20. The support elements 11, 14, 17 are therefore simply inserted into the respective cutout 12, 20 and held there by a frictional fit. The cutouts 12, 20 are preferably provided at inside edges of the plier type arms that face one another, so that the support element cannot be pressed out of the cutouts when forces are applied during opening of a can.

To be able to cut off the can lid as closely as possible along the edge of a rim of a can 31, the cutting wheel 5 is normally positioned to be inclined with respect to the plane of the can lid. With the proposal in accordance with the invention, it can easily be achieved that a notch or a groove 13, 18, 19 in the support element 11, 14, 17 that receives the cutting wheel 5 also extends in a direction that is inclined with respect to its axis of rotation. The desired inclined position of the cutter device 5 is easily attained by inserting the support element 11, 14, 17 into the cutout 12, 20 of the arm.

While the invention has been described with reference to the drawings and structures that are disclosed herein, it is not confined to details set forth herein and is intended to cover modifications or changes as may come within the scope of the following claims.

I claim:

1. A plier-type can opener comprising:

first and second arms (1,2) pivotally connected to each other;

a turning handle (4) for manually operating the can opener to open a can, said turning handle (4) having a shaft (10);

a plurality of rotatable components including a feed wheel (7), a cutter means (5) and first and second toothed wheels (6, 8);

a first preassembled unit mounted on one of said first and second arms, said first preassembled unit comprising said turning handle (4) and a support element (11, 14,17) made of plastic for rotatably supporting said turning handle (4), said support element including first frictional mounting means for frictionally mounting said first preassembled unit on said one of said first and second arms for supporting said first preassembled unit on said one of said first and second arms (1, 2), said first preassembled unit including at least one of the feed wheel and the cutter means as well as said first toothed wheel (6) mounted on said shaft (10) of the turning handle (4) so as to rotate as the turning handle (4) turns;

a second preassembled unit mounted on the other one of said first and second arms, said second preassembled unit comprising the second toothed wheel supported on another support element, the first toothed wheel included in the first preassembled unit being engageable with the second toothed wheel included in the second preassembled unit when the arms of said plier-type can opener are squeezed together to engage a portion of the can to be opened and the turning handle is manually turned;

said feed wheel (7) being mounted to one of the first and second preassembled units so as to rotate as said turning handle (4) is manually turned in order to advance the can to be opened;

the cutter means being mounted to one of the first and second preassembled units to rotate as said turning handle is manually turned, when the arms of said plier-type can opener are squeezed together;

second frictional mounting means for frictionally mounting the second preassembled unit on said other one of said first and second arms;

the support element (11) and the another support element (14, 17) respectively being inserted into a cutout (12) and another cutout (20), the cutout and another cutout being respectively provided in different ones of said first and second arms so that a different support element (11, 14, 17) is respectively held in said cutout and another cutout by a frictional fit to thereby mount the support element (11) and the another support element (14, 17) on different ones of the first and second arms (1, 2); and wherein:

one of the cutout (12) and the another cutout (20) are provided respectively on an inside edge portion of different ones of the first and second arms (1, 2) so that said cutout and said another cutout face each other; and the support element (11) and the another support element (14, 17) after insertion in the cutout (12) and the another cutout (20) are frictionally held in the cutout and the another cutout such that the support element and the another support element cannot be pressed out of the cutout (12) and the another cutout (20) when said first and second arms of said plier-type can opener are squeezed together.

2. The plier-type can opener according to claim 1, wherein an opening portion of the cutout in one of the first and second arms of the plier-type can opener faces an opening portion of the another cutout in the other arm of the plier-type can opener.

3. The plier-type can opener according to claim 1, wherein an opening portion of said cutout (12) in the one of the first and second arms of the plier-type can opener faces an opening portion of the another cutout (20) in the other one of the first and second arms of the plier-type can opener, and another support element (14) is frictionally fit into the another cutout.

* * * * *